United States Patent [19]

Tanaka et al.

[11] 4,305,004

[45] Dec. 8, 1981

[54] CURRENT SUPPLY CIRCUIT FOR ELECTRONIC EQUIPMENT OF AN AUTOMOTIVE VEHICLE

[75] Inventors: Hiroshi Tanaka, Yokosuka; Yukitsugu Hirota, Yokohama, both of Japan

[73] Assignee: Nissan Motor Co. Ltd., Yokohama, Japan

[21] Appl. No.: 131,452

[22] Filed: Mar. 18, 1980

[30] Foreign Application Priority Data

Mar. 20, 1979 [JP] Japan ..... 54-31736

[51] Int. Cl.[3] ..... F02P 11/00

[52] U.S. Cl. ..... 307/10 R; 307/100

[58] Field of Search ..... 307/9, 10 R, 100, 326, 307/327; 361/194

[56] References Cited

U.S. PATENT DOCUMENTS 3,745,362 7/1973 Ballou ..... 307/10 R

*Primary Examiner*—L. T. Hix

*Assistant Examiner*—James L. Dwyer

*Attorney, Agent, or Firm*—Lowe, King, Price & Becker

[57] ABSTRACT

A current supply circuit for electronic equipment of an automotive vehicle having an additional relay being energized by the ignition switch at its starter position. In this starter position, the relay is operated and the battery current is directly supplied to the electronic equipment at the time of starting the vehicle to avoid abrupt decrease of the source voltage.

1 Claim, 3 Drawing Figures

CURRENT SUPPLY CIRCUIT FOR ELECTRONIC EQUIPMENT OF AN AUTOMOTIVE VEHICLE

BACKGROUND OF THE INVENTION

1. Field of the Invention

The present invention relates to a circuit arrangement of a source current supply of a vehicle, in which the source voltage supply characteristics to the electronic equipment of reverse connection prevention type are improved especially at the time of the starting.

2. Description of the Prior Art

FIG. 1 shows one example of a conventional current supply circuit for vehicle electronic equipment of a reverse connection prevention type. In this figure, the reference numeral 1 designates positive (+) terminal of the battery, 2 an ignition switch, 3 an ignition relay, 4 an ignition line, 5 a diode for preventing reverse connection and 6 an electronic equipment comprising a constant voltage circuit. The electronic equipment may be, for instance, and electronic controlled fuel injection device having semiconductor elements, or a fully transistorized electric distributor circuit. Reference numeral 7 is a starter line.

This current supply circuit operates as follows. Namely, at the time of operation of the ignition relay 3 by the manual closure of the ignition switch 2, the contact 3*a* of the ignition relay becomes ON condition and the source voltage required for the operation of the electronic equipment 6 is supplied through the ignition line 4 and via a diode 5 coupled in the forward direction. In the drawing the reference numeral 4*a* designates an inductive load such as the alternator, the ignition coil, etc.

It has been the usual practice to insert the diode 5 for the protection of the electronic equipment having semiconductor parts. This is by a reason that an abnormally high reverse voltage might be induced at the time of switching off the ignition switch which results breakage of the semiconductor element. A same danger is expected by a mishandling to connect the battery terminal at reverse polarity.

In the aforementioned conventional current supply circuit for the electronic apparatus of a vehicle, the voltage to the electronic equipment 6 is supplied only through the ignition line 4 having the diode 5 inserted. This circuit arrangement has a disadvantage in that the supply voltage to the electronic equipment greatly decreases at the time of starting of the engine due to source voltage drop by the load such as the starter motor connected on the starter line 7 and also by the influence of the forward voltage drop of the diode 5. This decrease of the source supply voltage to the electronic equipment 6 may result unstable operation of the electronic equipment.

SUMMARY OF THE INVENTION

The present invention has for its object to mitigate the aforementioned disadvantage of the conventional supply current circuit.

In accordance with the present invention, a current supply circuit for electronic equipment of a vehicle realizing the abovementioned object is obtained by arranging the supply circuit to apply the battery voltage directly through a contact being put in ON condition at starter position of the ignition switch at the starting time thus to supply the current not passing through the diode provided for preventing damage which might be caused by reverse polarity connection.

EXPLANATION OF THE DRAWINGS

The invention will now be explained by referring to the accompanying drawings.

DESCRIPTION OF THE PREFERRED EMBODIMENT

Figure 1:
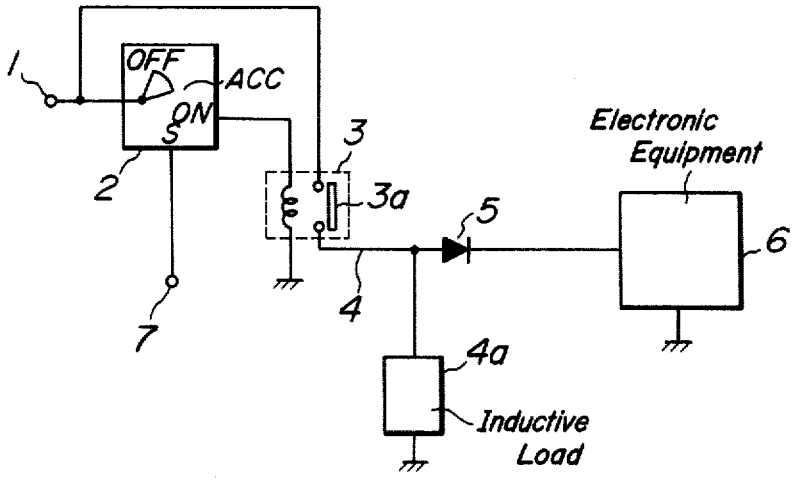
FIG. 1 PRIOR ART
FIG. 1 is an example of circuit diagram of the current supply circuit of a conventional type, which just have been explained hereinbefore.
Figure 2:
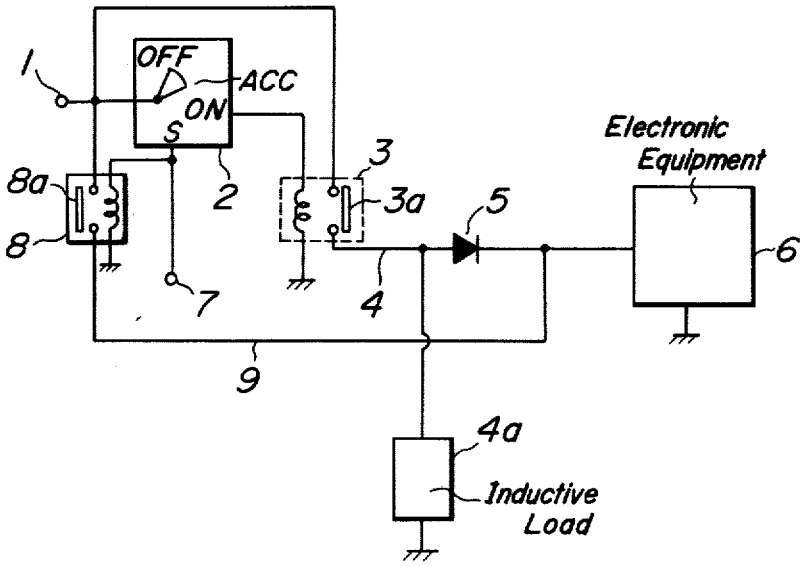
FIG. 2 shows one embodiment of the circuit diagram made in accordance with the present invention.

FIG. 2 shows one embodiment of the circuit diagram of the present invention. In the drawing the reference numeral 1 designates positive (+) terminal of the battery, 2 an ignition switch, 3 an ignition relay, 3*a* a normally open switch contact thereof, 4 an ignition line, 4*a* an inductive load, 5 a diode for protecting reverse connection, 6 an electronic equipment formed such as the constant voltage circuit or the like, and 7 the starter line. The aforementioned elements are the same as the conventional one as shown in FIG. 1.

In accordance with the present invention, a relay 8 is provided. This relay 8 operates at a time when the starter switch becomes ON condition, i.e. when the ignition switch 2 is located at the start position S. This relay 8 has a normally open switch contact 8*a*. An additional supply wire 9 is provided from the battery positive (+) terminal 1 to the electronic equipment 6 through the contact 8*a*.

This portion of the circuit operates as follows.

At first the driver turns on the ignition switch 2 for starting the engine to bring the switch element at the starter position S. By this operation, the starter line 7 is applied with the source voltage. By this source voltage, the relay 8 is energized and the contact 8*a* become ON condition. By this the supply voltage is not fed through the ignition line 4 but through the additional feeding line 9 is now supplied to the equipment 6. Namely at the start time, a source voltage which is not influenced by the voltage drop across the diode 5 is supplied to the equipment 6. Thus the source voltage drop supplied to the electronic equipment is avoided. By this arrangement, the function of the electronic equipment 6 at the time of starting can greatly be improved.

In this circuit arrangement, the contact 8*a* of the relay 8 becomes OFF condition other than the starting time, so usually the source voltage through the ignition line 4 and the diode 5 is supplied to the electronic equipment 6. The reverse polarity preventing function is the same.

Figure 3:
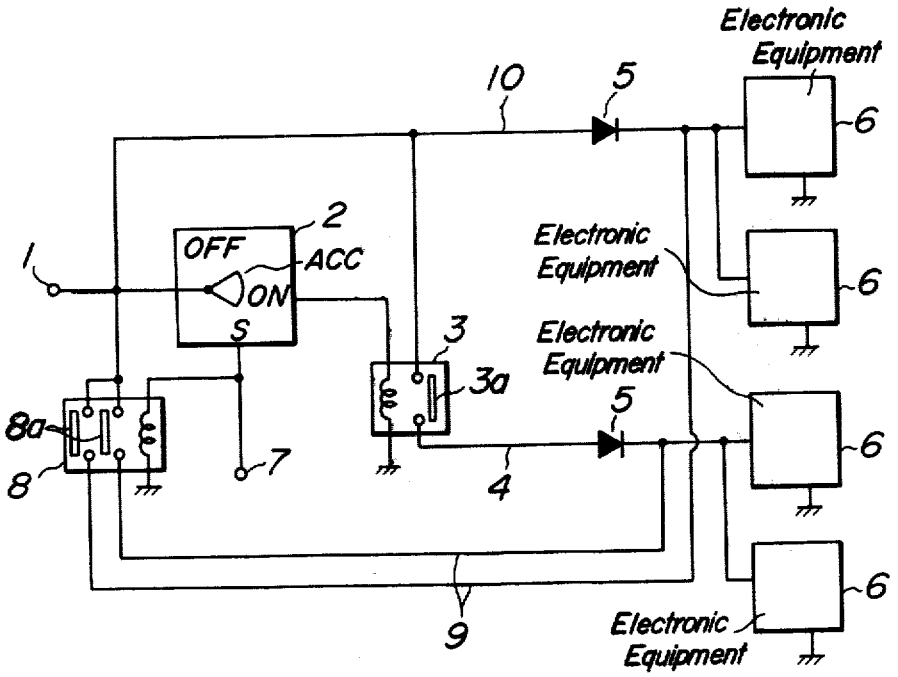
FIG. 3 is a modified embodiment of the circuit diagram of the present invention.

FIG. 3 shows further embodiment of the present invention. This circuit shows a case in which a plurality of the diodes 5 and the electronic equipments are connected to the ignition line 4 and to the battery line 10 (the circuit which must not pass through the ignition circuit, i.e. electric clock, lightening, etc.) respectively. This arrangement is particularly advantageous in improving the characteristics of the electronic equipment at the time of starting a vehicle. In this arrangement, the diodes for the protection of an erroneous reverse connection may be inserted one each for the battery line and for the ignition line. Therefore this circuit has a feature to save the number of the diodes. Further it has an advantage in that the number of the additional relay for improving the starting characteristics of the electronic equipment can be decreased to only one irrespective to the number of the electronic equipments.

As has been explained in the foregoing, the supply voltage to the electronic equipment especially for the constant voltage circuit is fed directly from the battery at the time of starting the engine via a contact which is placed in ON condition when the starter switch is thrown into ON state. Accordingly, voltage drop of the diode in the conventional current supply circuit can be removed so that voltage drop of the source voltage fed to the electronic equipment at the starting time of the engine is mitigated. This will greatly improve the starting characteristics of the constant voltage circuit.

What is claimed is:

1. A current supply circuit for electronic equipment of an automotive vehicle comprising a source battery being arranged to feed supply current to the electronic equipment through a contact of an ignition relay being operated by an ignition switch and a diode for protecting the equipment from reverse connection, the improvement comprising a contact being switched into ON condition at starter position of the ignition switch and feeding wire for feeding the battery supply to the electronic equipment through said contact.

* * * * *